US007837245B2

(12) United States Patent
Hailstone

(10) Patent No.: US 7,837,245 B2
(45) Date of Patent: Nov. 23, 2010

(54) CRANE SPREADER BEAM HAVING RADIO-CONTROLLED LOAD RELEASE

(76) Inventor: Chris D. Hailstone, 3724 W. 5600 South, Lake Shore, UT (US) 84660

( * ) Notice: Subject to any disclaimer, the term of this patent is extended or adjusted under 35 U.S.C. 154(b) by 679 days.

(21) Appl. No.: 11/753,188

(22) Filed: May 24, 2007

(65) Prior Publication Data

US 2007/0272643 A1 Nov. 29, 2007

Related U.S. Application Data

(60) Provisional application No. 60/802,872, filed on May 24, 2006.

(51) Int. Cl.
*B66C 1/12* (2006.01)

(52) U.S. Cl. ..... 294/81.5; 294/81.54; 294/82.3; 294/82.35; 294/905

(58) Field of Classification Search ..... 294/81.1, 294/81.5, 81.54, 82.23, 82.24, 82.3, 82.35, 294/905

See application file for complete search history.

(56) References Cited

U.S. PATENT DOCUMENTS

| | | | | |
|---|---|---|---|---|
| 1,426,764 | A * | 8/1922 | Parker | 294/81.5 |
| 3,578,373 | A * | 5/1971 | Metz | 294/82.3 |
| 3,895,836 | A * | 7/1975 | Barnes | 294/82.35 |
| 3,897,097 | A * | 7/1975 | Davis, Jr. | 294/81.5 |
| 4,109,798 | A | 8/1978 | Comyns-Carr | |
| 4,453,622 | A * | 6/1984 | Betz | 188/265 |
| 5,580,113 | A * | 12/1996 | Pomerville et al. | 294/82.35 |
| 7,380,849 | B2 * | 6/2008 | Mongan | 294/82.35 |
| 2005/0242602 | A1 | 11/2005 | Protesto | |

FOREIGN PATENT DOCUMENTS

JP 2-188392 A * 7/1990

OTHER PUBLICATIONS

EZ-Release advertisement on p. 56 of Jul. 2005 issue of American Cranes & Transport magazine.
RIG-Release advertisement on p. 41 of Aug. 2005 issue of American Cranes & Transport magazine.

* cited by examiner

*Primary Examiner*—Dean J Kramer
(74) *Attorney, Agent, or Firm*—Angus C. Fox, III

(57) ABSTRACT

A hollow crane spreader beam incorporates at least one radio-controlled load-release assemblies. Each assembly includes a slidable bolt that is coupled to the plunger of an electric-motor-driven, radio-controlled door lock unit that is installed within the beam. When in a first position, taken in response to application of first polarity voltage to the door lock motor, the bolt traps a free end of a load-supporting chain or cable between a pair of eye blocks, each having an aperture through which the bolt slides. When in a second position, taken in response to application of a second polarity voltage, the bolt releases the free end. The spreader beam also incorporates a radio receiver/controller unit and a battery that is coupled to both the radio receiver/controller unit and the multiple door lock units.

18 Claims, 4 Drawing Sheets

CRANE SPREADER BEAM HAVING RADIO-CONTROLLED LOAD RELEASE

This application has a priority date based on the filing of Provisional Patent Application No. 60/802,872 on May 24, 2006.

BACKGROUND OF THE INVENTION

1. Field of the Invention

The present invention relates to load lifting apparatus such as hooks and spreader beams normally used with cranes or other hoisting tackle or equipment, and more particularly, to load lifting apparatus having remote controlled load release capability.

2. Description of the Prior Art

Lifting devices and other apparatus used at the end of a lifting crane or other load bearing line are well developed in the prior art. Snap hooks, crane hooks, and other lifting apparatus are generally comprised of a hook shank which extends from the point of attachment of the hook to a load bearing line, down through an appropriate angle and a leading tip of the hook to form the shape to capture a chain, or other load bearing line secured to a load to be lifted by the hook, using a crane or other load bearing apparatus. The opening of a hook shape is sometimes referred to as the throat or mouth. There are a plethora of different hook designs which are employed in various applications, whether it be marine, industrial, or general categories of crane hooks for lifting loads or to affix the crane's load bearing line to a load to be lifted. The load or load bearing line is placed onto the hook through the throat of the hook.

A spreader beam is a generally linear lifting device having multiple, evenly-spaced load securing points. Spreader beams, or spreaders as they are commonly called, are frequently used to lift multiple identical items, such as metal or wood roof trusses. After a plurality of trusses are suspended from the spreader beam parallel to one another, the spreader beam and trusses are elevated with a crane and positioned on top of parallel, spaced-apart walls. After the trusses are secured to the walls, they are released from the spreader beam so that the latter can be reused. Typically, the lifted items are released from the spreader beam by a construction worker who climbs to the apex of each truss and releases each securing cable or chain individually. Depending on the height of the installed trusses, the release operation can be time consuming and pose the risk of a serious fall to the worker.

Although the use of spreader beams having hooks with open throats have been used on the sly to a limited extent, the use of such equipment is unsafe. While moving a load with a crane, occasionally the load may contact the ground or some other object and, thereby, become disengaged from the hook. The danger is exacerbated when a spreader beam is used, as the loss of an item suspended at one end of the beam will cause a serious imbalance problem with the remaining items, possibly causing unwanted release of all the suspended items.

The operator of the crane attached to the hook sometimes jogs the load to place the load in a specific targeted position before disengaging the hook from the load. Jogging is an operation to move a crane or trolley crane bridge in a series of short, discontinuous increments by momentary operation of a controller normally accomplished at the end of a lifting cycle to place a load in a precisely targeted resting point after conveyance of the load over a larger distance. Frequently, when jogging a hook or a spreader beam with multiple hooks, the suspended load will bounce off of the ground or other structures as it is finally moved into its desired position before release of the lifting apparatus. Premature or unintended release of loads or lifting straps affixed to loads occurs most frequently at this point in the operation of the apparatus, causing a hazardous condition to property and personnel in the immediate area.

The bouncing or vibration of the load caused by jogging may cause the lift straps, the load resting on the hook, or other load bearing lines to be momentarily disengaged from the load bearing portion of the hook, sometimes bouncing back out of the throat area of the hook, thereby causing complete disengagement of the load. In that regard, in the past various catch mechanisms or spring hooks have been developed for the purpose of requiring that a specific operation occur before release of the load from the hook such as to prevent accidental disengagement through the throat of the hook or to otherwise be sure that the load is not disengaged until the user manipulates the latching mechanism to disengage the load. Most existing load securing devices require direct manipulation of a hook mounted safety latch to release the load.

In crane lifting operations, to expedite matters and to prevent as little inconvenience or time delay as possible, it would be desirable to have radio-controlled release of one or more load securing straps or chains on a device for lifting single or multiple items, respectively. As an added safety feature, the straps or chains should not be releaseable as long as a load item is suspended from each strap or chain.

SUMMARY OF THE INVENTION

The present invention provides a load-release assembly that is securable to the lifting cable of a crane. The load-release assembly includes a housing, first and second spaced-apart, axially-aligned eye blocks rigidly affixed to the housing, a load-supporting chain or cable having one end thereof permanently secured to the housing, a moveable bolt which can pass through the eyes of both blocks and span the gap between the eye blocks, an electric-motor-driven door lock unit secured to the housing, said door lock unit having a moveable plunger that is coupled to the bolt, said plunger withdrawing the bolt from the first eye and opening the gap in response to a first, or unlocking, polarity voltage being applied to the electric motor of the door lock unit, and reinserting the bolt into the first eye so that it spans the gap between the first and second eyes, in response to an opposite, or locking, polarity voltage being applied to the electric motor of the door lock unit. A portion of the bolt spanning the gap between the two eye blocks can be used to secure the free end of the chain or a looped end of the cable. The load release assembly also includes a radio receiver/controller unit and a battery (preferably of a rechargeable type) that is coupled to both the radio receiver/controller unit and the door lock unit. A radio transmitter, which is separate from the load-release assembly, is used to send a digital code, which can be either encrypted or non-encrypted, to the radio receiver/controller unit. The digital code, which includes either a lock or unlock signal, is verified by the controller unit, which then applies battery power to the door lock unit, having a polarity corresponding to the lock or unlock signal, thereby causing the electric-motor-driven door lock unit to either lock or unlock the bolt as desired.

The load-release assembly can be configured for a single-load release or for simultaneous, multiple-load releases. For multiple-load-release embodiments, the assembly can be configured as a spreader beam for lifting such items as roof trusses. For such an embodiment, a single radio receiver/controller unit is coupled to multiple door lock motors, each of which controls an individual load-release station. For an embodiment of the invention that has heretofore been physically reduced to practice, a 2-inch (5.08 cm) by 5-inch (12.7 cm) tube of rectangular of rectangular cross section is used to house all of the electrical components, including the battery, the radio receiver/controller unit, multiple door lock units, and all required wiring connections between the components. The ends of the tube are capped, and removable panels provide access to the electrical components. The eyes are welded to a bottom edge of the tube and the bolt associated with each pair of eyes is, of course, external to the tube and moves parallel to the central longitudinal axis the tube. Multiple links, each of which projects through a slit in the bottom edge of the tube, connect the plunger of each door lock unit with its respective bolt. A shackle, by means of which the load-release assembly is secured to the cable of a crane, is attached to the center of the tube.

DETAILED DESCRIPTION OF THE INVENTION

The invention will now be described with reference to the attached drawing figures. It should be understood that the drawings are not necessarily drawn to scale and are meant to be merely illustrative of the invention.

Figure 1:
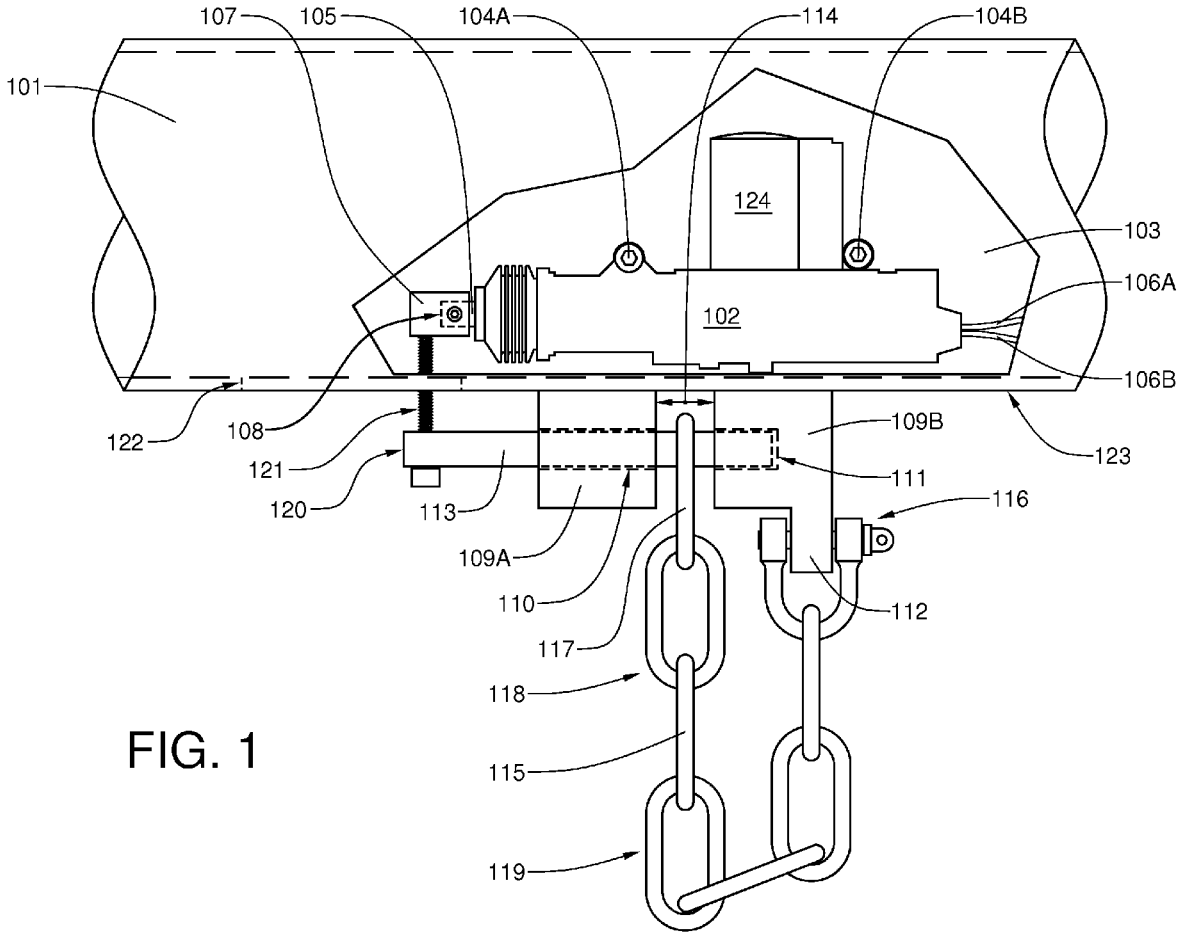
FIG. 1 is a partial cut-away view of a single load release unit of a load release assembly.

Referring now to FIG. 1, a single load-release unit includes a hollow metal housing 101 of generally rectangular cross section. The invention has heretofore been physically reduced to practice using a 2-inch (5.08 cm) by 5-inch (12.7 cm) hollow steel tube housing. A door lock unit 102 is secured to the far side 103 of the tube 101 with alien head screws 104A and 104B. The door lock unit 102 has a moveable plunger 105 that is bidirectionally moveable in an x-axis direction. Directionality of movement is determined by the polarity of the power applied to the input wires 106A and 106B. A coupler fitting 107 is secured to the external end 108 of the plunger 105. First and second eye blocks 109A and 109B are welded to the bottom surface of the steel tube 101. The first eye block 109A has a central through aperture 110, while the second eye block 109B has a central blind aperture 111 that is coaxial with the through aperture 110. The second eye block 109B is also equipped with a shackle attachment extension 112. When a bolt 113 slides through the through aperture 110 and into the blind aperture 111, it spans the gap 114 between eyeblocks 109A and 109B. A load-support chain 115 is secured to the second eye block 109B with a U-shaped shackle, or clevis, 116. The bolt 113 can be passed through a link 117 of the free end 118 of the load-support chain 115 so that the chain 115 is trapped within the gap 114. When the bolt is withdrawn so that it no longer spans the gap 114, the link 117 is released. A load can be secured within the loop 119 formed by the chain 115 when it is trapped by the bolt. The left end 120 of the bolt 113 is drilled to accept a threaded link screw 121 that couples the bolt 113 to the plunger 105 of the door lock unit 102 through a slot 122 that is cut in the bottom panel 123 of the steel tube 101. When a load is supported by the load-support chain 115, the electric actuator motor 124 of the door lock unit 102 has insufficient torque to move the bolt 113, due to the increased friction load on the bolt caused by the load. It should be evident that installation of the door lock unit 102 is most easily accomplished through the use of access panels (not shown) which cover holes cut in the steel tube. Alternatively, the door lock units can be installed through either end of the steel tube 101 in order to minimize any loss of structural integrity to the tube 101. All that is needed in such a case is are a few small driver holes so that a screw driver or alien wrench can access the screws 104A and 104B. As will be subsequently seen, a radio receiver/controller and battery are required to complete the load lift assembly, and these items can also be installed within the steel tube 101. Automotive door lock units are ideal for the application, as the key-fob-size transmitters which are used to activate the door lock units have appropriate range for the load-lifting application.

Figure 2:
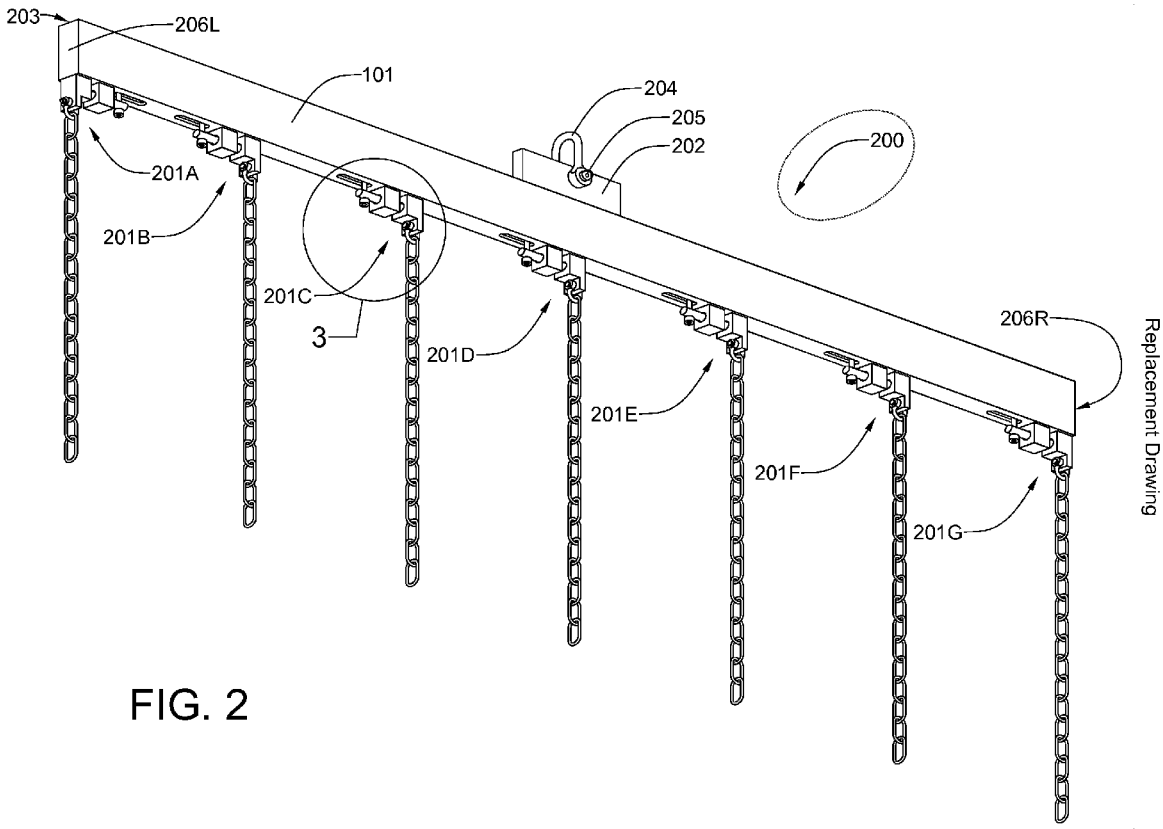
FIG. 2 is an isometric view of a spreader beam embodiment of the load release assembly which incorporates seven load release units.

Referring now to FIG. 2, a spreader beam 200 is shown which incorporates seven load-release units 201A, 201B, 201C, 201D, 201E, 201F and 201G. It will be noted that the load-release unit 201A is reversed with respect to the other six so that the spreader beam can be constructed with a shorter steel tube 101 than if load-release unit 201A were oriented like the other six. This does not pose a problem, as the power input wires will be reversed on load-release unit 201A. In other words, when the plunger of unit 201A is extending from the door lock unit body associated therewith, the plungers of the other units 201B-201G will be retracting into their respective door lock unit bodies. It will also be noted that a support plate 202 having a central aperture (not shown) has been welded to the top wall 203 of the steel tube 101, and a large shackle 204 has been secured to the support plate 202 with a threaded pin 205, which passes through the central aperture. The ends 206L and 206R of the steel tube 101 are capped, and removable panels may provide access to the electrical components.

Figure 3:
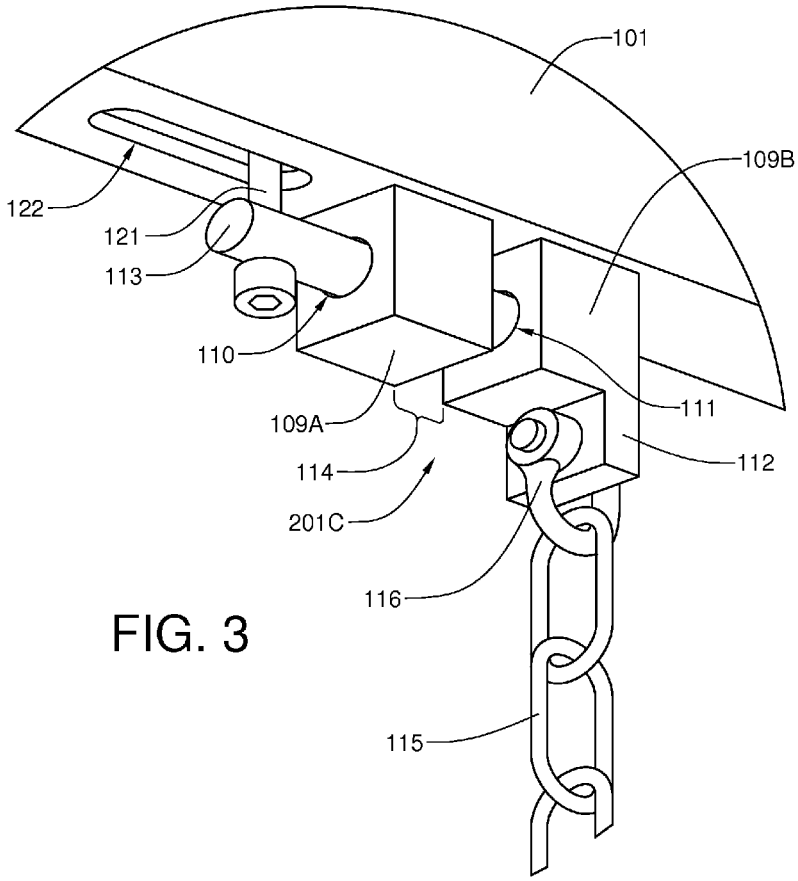
FIG. 3 is a close-up view of circular region 3 of FIG. 2.

Referring now to FIG. 3, a closeup view of the circled region 3 in FIG. 2 is shown.

Figure 4:
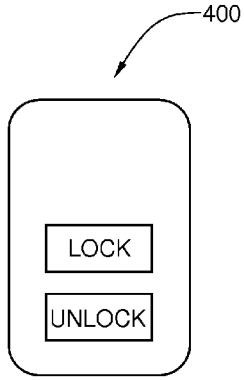
FIG. 4 is a plan view of a key fob transmitter.

Referring now to FIG. 4, a key fob radio transmitter 400, of the type used to lock and unlock automobile doors is shown. Such a transmitter can be used to send lock and unlock signals to the door lock units of the load-release assemblies constructed in accordance with the present invention.

Figure 5:
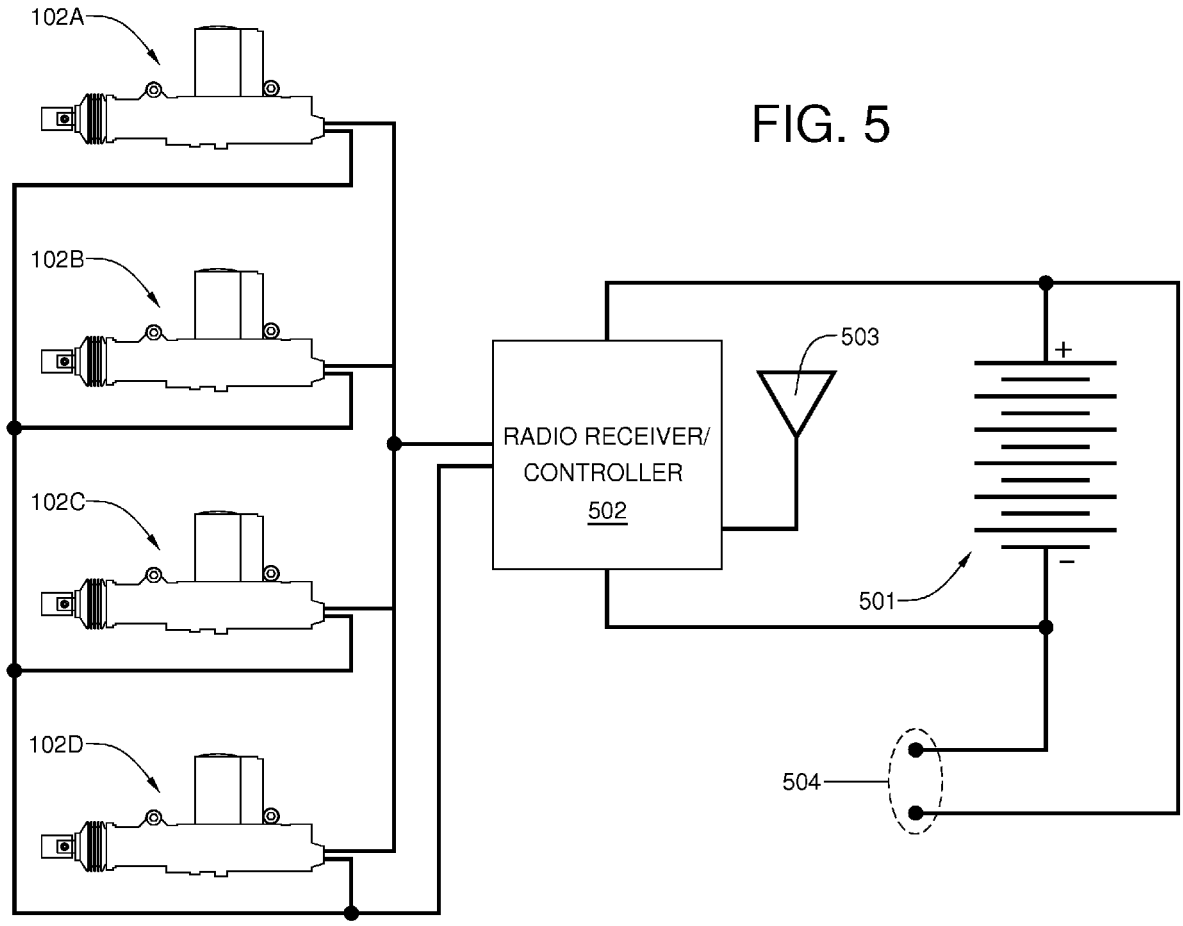
FIG. 5 is a block diagram of the electrical components of a load release assembly comprising multiple load release units.

Referring now to FIG. 5, a system diagram shows the components that are installed in a load-release assembly constructed in accordance with the present invention. A 12-volt battery 501 is coupled to a radio receiver/controller unit 502. The antenna 503 of the radio receiver/controller 502 receives digitally-encoded signals emitted from the key fob transmitter 400. The digital code, which may be encrypted or unencrypted and includes either a lock or unlock signal, is verified by the radio receiver/controller unit 502, which then applies battery power of the appropriate polarity for the received signal to the door lock units 102A, 102B, 102C and 102D, thereby causing the electric-motor-driven door lock units 102A-102D to either lock or unlock the bolt as desired. The battery 501 can be recharged through the battery recharge terminals 504.

Although only several embodiments of the invention have been disclosed herein, it will be obvious to those having ordinary skill in the art that changes and modifications may be made thereto without departing from the spirit and scope of the invention as hereinafter claimed.

What is claimed is:

1. A load-lifting fixture comprising:

a hollow spreader beam;

a plurality of load release assemblies, each load release assembly including a door lock unit having an electric actuator motor secured within said hollow spreader beam, said door lock unit having a plunger movable in a first direction in response to application of a first polarity voltage to the electric actuator motor and in a second direction in response to application of a second and opposite polarity voltage;

first and second spaced-apart eye blocks secured to an exterior surface of said hollow spreader beam and having a gap therebetween, each eye block having a cylindrical aperture that is coaxial with the aperture of the other eye block;

a bolt mechanically coupled to the plunger through a slot in a wall of said hollow spreader beam, said bolt being slidable within the apertures of both eye blocks, said bolt moving in concert with said plunger in said first direction to span the gap between said eye blocks, and moving in said second direction to open the gap;

a loopable load securing member having a first end permanently secured to said hollow spreader beam, and a second end capturable within the gap by said bolt;

a battery for providing said first and second polarity voltages to said electric actuator motor; and a radio receiver/controller unit for receiving radio control signals from a transmitter controlled by an operator, said radio receiver/controller unit directing a voltage of appropriate polarity to said door lock unit in accordance with a received radio control signal.

2. The load-lifting fixture of claim 1, wherein a number of load release assemblies exceeds two, and all of the gaps of the load-release assemblies are linearly and evenly spaced from one another.

3. The load-lifting fixture of claim 1, wherein said hollow spreader beam is a metal tube of generally rectangular cross section.

4. The load-lifting fixture of claim 3, wherein each load release assembly is affixed to the inside of the tube with threaded fasteners.

5. The load-lifting fixture of claim 1, wherein said loopable load securing member is selected from the group consisting of chains and looped-end cables.

6. The load-lifting fixture of claim 1, wherein said loopable load securing member is secured to an eye block with a shackle.

7. The load-lifting fixture of claim 1, wherein said electric actuator motor has sufficient torque to move the plunger in concert with the sliding bolt only when there is no load on the loopable load-securing member.

8. The load-lifting fixture of claim 1, which further comprises:

a support plate secured to a top portion of said hollow spreader beam; and a shackle secured to the support plate, said shackle providing an anchor for a lifting cable of a crane.

9. A crane spreader beam comprising:

a hollow tube;

multiple load release assemblies, each assembly including a door lock unit having an electric actuator motor secured within said hollow tube, said door lock unit having a plunger linearly movable along a first axis in a first direction in response to application of a first polarity voltage to the electric actuator motor and in a second direction in response to application of a second and opposite polarity voltage;

first and second spaced-apart eye blocks secured to an exterior surface of said hollow tube and having a gap therebetween, each eye block having a cylindrical aperture that is coaxial with the aperture of the other eye block;

a generally cylindrical bolt mechanically coupled to the plunger through a slot in a wall of said tube for each load release assembly, said cylindrical bolt being slidable within the apertures of both eye blocks along a second axis that is parallel to said first axis, said bolt moving between a first position where it spans the gap between said eye blocks, and a second position where it withdraws from the gap;

a load-securing section of chain having a first end permanently coupled to said hollow tube, and a free second end capturable within the gap by said bolt;

a battery for providing said first and second polarity voltages to said electric actuator motor; and a radio receiver/controller unit for receiving radio control signals from a transmitter controlled by an operator, said radio receiver/controller unit directing a voltage of appropriate polarity to said door lock unit in accordance with a received radio control signal.

10. The crane spreader beam of claim 9, wherein each door lock unit is secured within said hollow tube with treaded threaded fasteners.

11. The crane spreader beam of claim 10, wherein each door lock unit is accessible via a removable access panel secured to an outer surface of said hollow tube.

12. The crane spreader beam of claim 10, wherein each door lock unit is inserted within said hollow tube from an end of said beam and secured to a rear wall of said tube with threaded fasteners accessible through holes in the hollow tube that are much smaller than a door lock unit so as to minimize a reduction in strength of said hollow tube.

13. The crane spreader beam of claim 9, wherein said first end of each section of chain is secured to an eye block of an associated load release assembly with a shackle.

14. The crane spreader beam of claim 9, wherein a door lock unit at one end of the beam is wired so that its plunger moves in a direction that is always opposite the direction that the plungers of the other door lock units are moving at the same time.

15. The crane spreader beam of claim 9, wherein a number of load release assemblies exceeds two, and all of the gaps of the load-release assemblies are linearly and evenly spaced from one another.

16. The crane spreader beam of claim 9, which further comprises:

a support plate secured to a top, center-of-gravity portion of the hollow metal tube; and a shackle secured to the support plate, said shackle providing an anchor for a lifting cable of a crane.

17. The crane spreader beam of claim 9, wherein each electric actuator motor has sufficient torque to move the plunger in concert with the sliding bolt only when there is no load on the load-securing section of chain, thereby preventing accidental discharge of carried loads when the crane spreader beam is being moved by a crane.

18. The crane spreader beam of claim 9, wherein said door lock unit is designed for automotive use, and said radio receiver/controller can receive control signals from a transmitter the size of a key fob.

* * * * *